US012221801B2

(12) United States Patent
Furseth et al.

(10) Patent No.: US 12,221,801 B2
(45) Date of Patent: Feb. 11, 2025

(54) SHELTER SUPPORT POLE WITH ROTATING EXTENSION MECHANISM

(71) Applicant: ARDISAM, INC., Cumberland, WI (US)

(72) Inventors: Michael Furseth, Cumberland, WI (US); Chuck Librande, Rice Lake, WI (US)

(73) Assignee: ARDISAM, INC., Cumberland, WI (US)

( * ) Notice: Subject to any disclaimer, the term of this patent is extended or adjusted under 35 U.S.C. 154(b) by 236 days.

(21) Appl. No.: 17/804,266

(22) Filed: May 26, 2022

(65) Prior Publication Data

US 2023/0383567 A1 Nov. 30, 2023

(51) Int. Cl.
*E04H 15/46* (2006.01)
*E04H 15/60* (2006.01)

(52) U.S. Cl.
CPC ..... *E04H 15/46* (2013.01); *E04H 15/60* (2013.01)

(58) Field of Classification Search
CPC ..... E04H 15/46; E04H 15/60
USPC ..... 135/138, 140, 142, 114
See application file for complete search history.

(56) References Cited

U.S. PATENT DOCUMENTS 221,442 A * 11/1879 Broome ..... F16L 37/2445 285/396
305,140 A * 9/1884 Bradley ..... F16B 7/20 279/93
866,335 A * 9/1907 Cook ..... E04H 15/60 135/121
1,033,187 A * 7/1912 Metzger ..... F16L 37/252 285/376

(Continued)

FOREIGN PATENT DOCUMENTS

CN 102535945 A 7/2012
CN 211691769 U 10/2020

(Continued)

OTHER PUBLICATIONS

Barronett Blinds, "How to Set-up and Take-down a Hub Blind from Barronett Blinds", YouTube, URL: https://www.youtube.com/watch?v=gEO1EBG5EQg, Jul. 18, 2013.

(Continued)

*Primary Examiner* — David R Dunn
*Assistant Examiner* — Danielle Jackson
(74) *Attorney, Agent, or Firm* — Perkins Coie LLP

(57) ABSTRACT

A shelter includes a frame structure with a plurality of pole structures. In some embodiments, a telescoping pole structure includes a shell pole portion extending along a longitudinal axis, a sleeve fixed to the shell pole portion, and an inner pole portion extending along the longitudinal axis and positioned at least partially within the shell pole portion and at least partially within the sleeve. The inner pole portion (Continued)

slides telescopically relative to the shell pole portion. The sleeve may be rotatable and it may include an engagement surface having one or more surface positions for contacting a detent element attached to the inner pole portion. Contact between the detent element and each of the one or more surface positions prevents the inner pole portion from moving telescopically into the shell pole portion. Turning the sleeve may extend or retract the telescoping pole structure.

14 Claims, 8 Drawing Sheets

(56) References Cited

U.S. PATENT DOCUMENTS 1,282,681 A * 10/1918 Faribault ..... E04H 15/60 285/402
1,502,898 A 7/1924 Berg
2,513,764 A 7/1950 Vonder
2,953,145 A 9/1960 Moss et al.
3,266,503 A 8/1966 Hoiness et al.
3,327,723 A 6/1967 Burgin
3,865,123 A 2/1975 Bracken
4,066,089 A 1/1978 Rainwater
4,239,247 A 12/1980 Hinz
4,518,162 A * 5/1985 Oates ..... A63B 21/072 403/349
4,585,020 A 4/1986 Masuda et al.
4,938,243 A 7/1990 Foster
5,046,882 A 9/1991 Ju
5,271,423 A 12/1993 Eychaner
5,513,622 A * 5/1996 Musacchia, Sr. ..... F41B 5/1426 403/349
5,749,387 A 5/1998 Thompson
6,089,247 A 7/2000 Price
6,216,717 B1 4/2001 Chen
6,279,877 B1 * 8/2001 Davis ..... H02G 1/083 254/134.3 R
6,666,223 B2 12/2003 Price et al.
6,776,179 B1 8/2004 Chen
6,868,858 B2 3/2005 Suh
6,951,327 B1 10/2005 Seo
7,168,439 B2 1/2007 Patel et al.
7,357,140 B2 4/2008 Chu et al.
7,607,447 B1 10/2009 Han
7,637,276 B2 12/2009 Mallookis et al.
7,640,942 B2 1/2010 Chu
7,703,469 B2 4/2010 Danziger
7,841,355 B2 * 11/2010 Livacich ..... E04H 15/001 135/120.3
7,845,364 B2 12/2010 Tolmie
7,886,756 B2 * 2/2011 Chen ..... B25G 3/16 135/25.4
8,056,573 B2 11/2011 Panigot
8,079,380 B2 12/2011 Engstrom et al.
8,746,179 B2 6/2014 Farmer et al.
8,776,816 B2 7/2014 Danziger
8,789,550 B2 * 7/2014 Livacich ..... E04H 15/001 135/120.3
9,194,153 B2 11/2015 Makos et al.
9,340,992 B2 5/2016 Huang
9,506,269 B2 11/2016 Armstrong et al.
9,644,387 B2 5/2017 Makos et al.
10,058,181 B2 8/2018 Makos
10,612,265 B1 4/2020 Walter
10,676,955 B1 6/2020 Tufto et al.
11,428,023 B2 * 8/2022 Furseth ..... E04H 15/46
11,686,121 B2 * 6/2023 Furseth ..... E04H 15/60 135/98
2006/0238005 A1 10/2006 Walter et al.
2007/0051399 A1 3/2007 Jung
2009/0320893 A1 12/2009 Engstrom et al.
2010/0126546 A1 5/2010 Chen
2012/0042920 A1 2/2012 Armstrong et al.
2012/0186619 A1 7/2012 Makos
2013/0008478 A1 1/2013 Prieto Estebanez
2014/0109945 A1 4/2014 Jin
2014/0130837 A1 5/2014 Sy-facunda
2014/0202509 A1 7/2014 Schamberger et al.
2015/0376912 A1 * 12/2015 Livacich ..... E04H 15/60 135/120.3
2016/0010357 A1 1/2016 Makos et al.
2017/0339941 A1 11/2017 Burchfield
2021/0332607 A1 * 10/2021 Goldszer ..... B62B 3/02
2021/0396037 A1 12/2021 Furseth et al.
2022/0136276 A1 5/2022 Furseth et al.
2022/0205270 A1 6/2022 Jerry et al.

FOREIGN PATENT DOCUMENTS

GB 190884 A * 1/1923
KR 20090045701 A 5/2009

OTHER PUBLICATIONS

Clam Outdoors, "XL Thermal House, YouTube", URL: https://www.youtube.com/watch?v=tCOQJUOatnk, Nov. 10, 2019.
Clam Outdoors, "Yukon XL Thermal Ice Fishing Shelter", URL: https://shop.clamoutdoors.com/yukon-xl-thermal.html; web page visited Dec. 7, 2020.
Eskimo Fishing Gear, "Sled Style Shelters", URL: https://geteskimo.com/collections/sled; web page visited Dec. 11, 2020.
Gazebo Store, "Easy Pop-Up Party Tent", available at https://www.thegazebostore.com/easy-pop-up-party-tent-13-x-13.html, exact publication date unknown, web site visited Jun. 18, 2020.
Habo Habo, "Tent with Hub—Six-Sided Tent with Accessories", available at https://www.aliexpress.com/i/4000340662867.html; exact publication date unknown, web page visited Sep. 12, 2020.
Helinox, "Outdoor Furniture", URL: https://helinox.com/pages/our-story; web page visited Dec. 11, 2020.
Houzz, "Outsunny 13'×13' Adjustable Height Pop Up Canopy Party Tent with Easy Setup", URL: https://www.houzz.com/products/outsunny-13-x-13-adjustable-height-pop-up-canopy-party-tent-with-easy-setup-prvw-vr~87130317; web page visited Dec. 7, 2020.
Ice Forts Custom Fish Houses, "XT Pro Lodge Shelter", URL: https://iceforts.com/product/xt-pro-lodge-shelter/; web page visited Dec. 11, 2020.
Kapsco Moto, "4 Bow Boat Bimini Top Cover", URL: https://www.sportsrecreationmall.com/product.jhtm?sku=kpscm3541&utm_medium=CPA&utm_campaign=commissionjunction&utm_source=affiliate&content=46157&cjevent=1d6458ad3bbd11eb823601670a1c0e0d; web page visited Dec. 7, 2020.
Michigan Sportsman Forum, "Ground Blind Roof Collapse", URL: https://www.michigan-sportsman.com/forum/threads/ground-blind-roof-collapse.517897/; Sep. 2014; web page visited Dec. 7, 2020.
Mountains for Everyone, "What Is Freestanding Tent", URL: https://mountainsforeverybody.com/what-is-freestanding-tent-and-what-is-non-freestanding-tent; web page visited Dec. 11, 2020.
Pegasus Auto Racing Supplies, "EZ-UP Snap Button for Legs", Available at https://www.pegasusautoracing.com/productdetails.asp?RecID=4867, exact publication unknown, website visited Sep. 12, 2020.
Rock West Composites, "Telescoping Clamps", URL: https://www.rockwestcomposites.com/shop/connector-accessories/locking-telescoping-mechanisms/telescoping-clamps, web page visited Dec. 16, 2020.
Taylor Made, "Bimini Support Poles", URL: https://www.taylormadeproducts.com/products/biminis/support-poles/, web page visited Dec. 7, 2020.

* cited by examiner

SHELTER SUPPORT POLE WITH ROTATING EXTENSION MECHANISM

BACKGROUND

Conventional portable shelters, such as tents, blinds, or gazebos, may include a roof with a central hub and several support poles extending from the central hub to support a covering material. Although such shelters are generally intended to be temporary, some users leave the shelters installed in place over extended periods of time. Conventional portable shelters, however, tend to collapse when left out for extended periods of time. For example, wind may knock them over or snow may cause them to collapse. Aspects of embodiments of the present technology address these issues and other issues.

SUMMARY

Representative embodiments of the present technology include shelter support poles with rotating extension mechanisms, frame structures that implement the shelter support poles, and shelters that implement the frame structures.

In some embodiments, a telescoping pole structure for a shelter includes a shell pole portion extending along a longitudinal axis; a sleeve fixed to the shell pole portion; an inner pole portion extending along the longitudinal axis and positioned at least partially within the shell pole portion and at least partially within the sleeve, wherein the inner pole portion slides telescopically relative to the shell pole portion; and a detent element fixed to the inner pole portion. In some embodiments, the sleeve includes an engagement surface having one or more surface positions for contacting the detent element, the sleeve is rotatable relative to the inner pole portion, and contact between the detent element and each of the one or more surface positions prevents the inner pole portion from moving telescopically into the shell pole portion.

In some embodiments, a frame structure for a shelter includes a center hub structure and a plurality of pole structures, each pole structure of the plurality of pole structures configured to span between the center hub structure and a corner of the frame structure, wherein at least one of the pole structures includes a telescoping pole structure configured in accordance with embodiments of the present technology.

In some embodiments, a shelter includes a frame structure and one or more cover panels attached to the frame structure. The frame structure may include a plurality of pole structures interconnected with one or more hub structures. The pole structures and the hub structures may form one or more side portions of the frame structure and a roof portion of the frame structure. The frame structure may include a telescoping pole structure configured in accordance with embodiments of the present technology.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views:

FIG. 4A shows a side view of the telescoping pole structure. FIG. 4B shows a side exploded view of the telescoping pole structure. FIG. 4C shows a side cross-sectional view of the telescoping pole structure.

FIG. 5A shows a detent element engaging a first position on an engagement surface. FIG. 5B shows the detent element engaging a second position on the engagement surface. FIG. 5C shows the detent element engaging a third position on the engagement surface.

DETAILED DESCRIPTION

The present technology is directed to shelter support poles with extension mechanisms, shelters incorporating support poles with extension mechanisms, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. Accordingly, embodiments of the present technology may include additional elements or exclude some of the elements described below with reference to FIGS. 1-8, which illustrate examples of the technology.

The terminology used in this description is intended to be interpreted in its broadest reasonable manner, even though it is being used in conjunction with a detailed description of certain specific embodiments of the technology. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all the items in the list, or (c) any combination of items in the list. Further, unless otherwise specified, terms such as "attached" or "connected" are intended to include integral connections, as well as connections between physically separate components.

Figure 1:
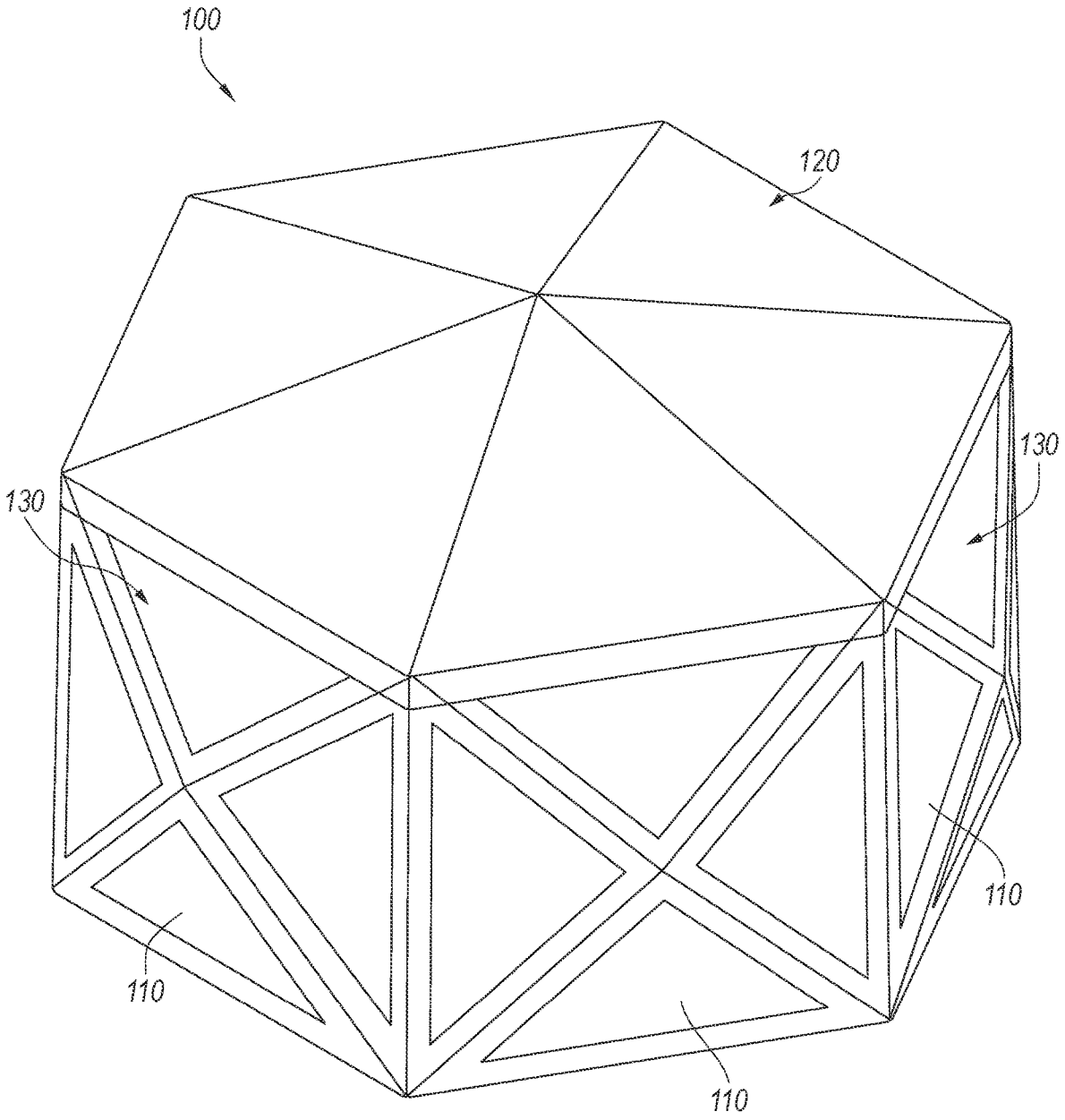
FIG. 1 illustrates a shelter configured in accordance with embodiments of the present technology.

FIG. 1 illustrates a shelter 100 configured in accordance with embodiments of the present technology. The shelter 100 may include a plurality of cover panels, such as side panels 110 and a roof 120. In some embodiments, the shelter 100 may include six side panels 110. In other embodiments, the shelter 100 may include more or fewer than six side panels 110. One or more of the side panels 110 may include one or more windows 130, each of which may be in the form of an opening in a side panel 110, and which may be coverable with a cover or flap. One or more of the side panels 110 may include a large door opening. In some embodiments, one or more of the side panels 110 may be omitted to form a shelter 100 with only a roof 120, or with one or more open sides. Each of the side panels 110 and the roof 120 may include one or more sheets of a cover material, such as a fabric or plastic material, which is attached to, and supported by, a frame structure of the shelter 100. A representative frame structure is described below and illustrated in FIG. 2.

Figure 2:
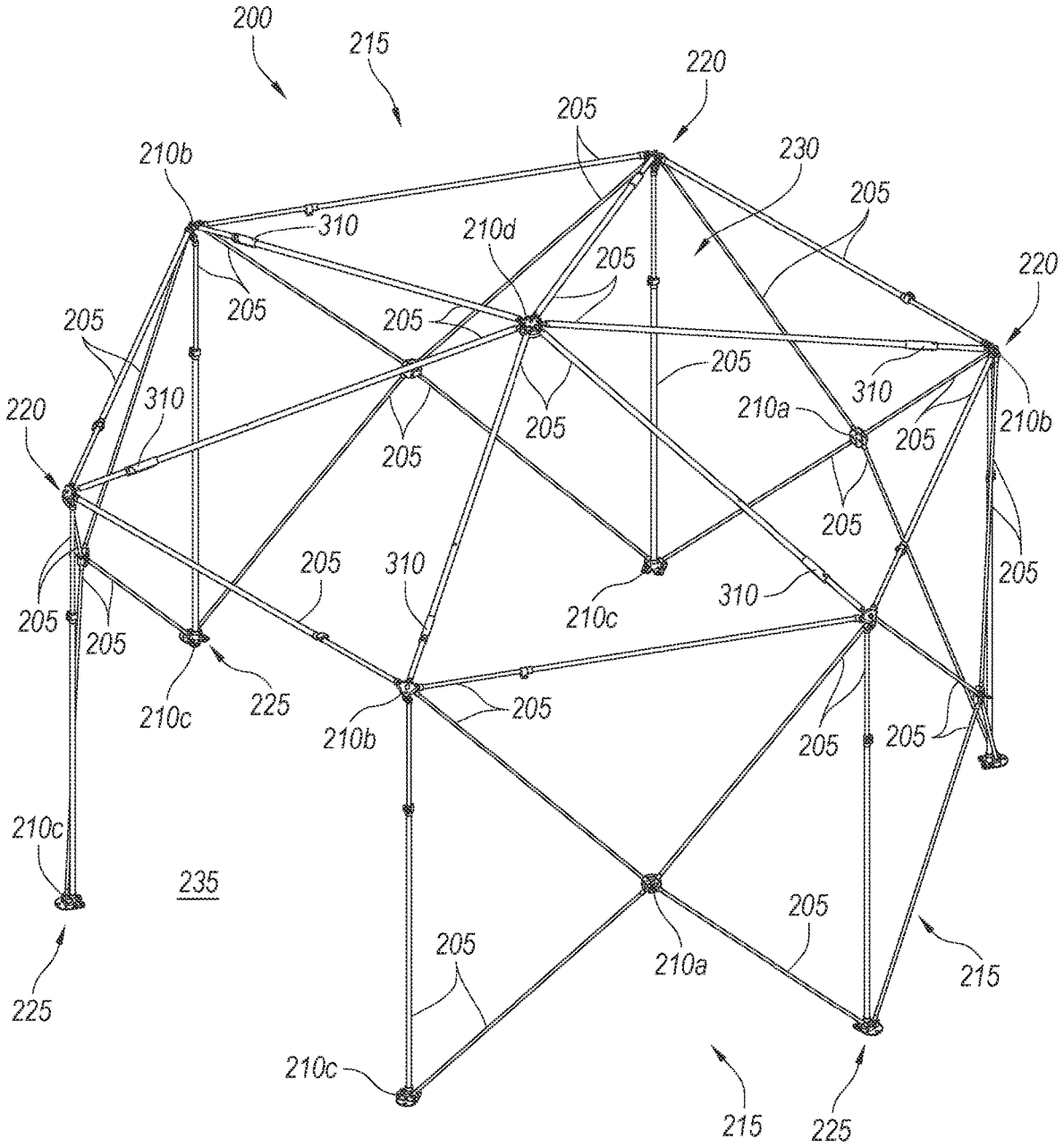
FIG. 2 illustrates a frame structure for a shelter, configured in accordance with embodiments of the present technology.

FIG. 2 illustrates a frame structure 200 for a shelter (such as the shelter 100), configured in accordance with embodiments of the present technology. In some embodiments, the frame structure 200 may include a plurality of pole structures 205 interconnected with one or more hub structures 210*a*, 210*b*, 210*c*, 210*d*. The pole structures 205 may be removably attachable to the one or more hub structures 210*a*, 210*b*, 210*c*, 210*d* or pivotable relative to the one or more hub structures 210*a*, 210*b*, 210*c*, 210*d* for assembly and disassembly of the frame structure 200 (and the overall shelter). The pole structures 205 span between the one or more hub structures 210*a*, 210*b*, 210*c*, 210*d* to form the frame structure 200. The frame structure 200 supports the sheets of cover material forming the side panels 110 and the roof 120 (see FIG. 1). The panels may be attached to the frame structure 200 with fasteners, straps, or other suitable attachment devices.

The pole structures 205 may be extendable and contractable (for example, by telescoping) to facilitate assembly, disassembly, or transformation of the frame structure 200 (and, correspondingly, the shelter, such as the shelter 100 shown in FIG. 1) between a disassembled or stowed configuration and an assembled or deployed configuration. FIG. 2 illustrates a deployed or assembled configuration. The one or more hub structures may include one or more side hub structures 210*a* for joining pole structures 205 in one or more side portions 215 of the frame structure 200; one or more upper corner hub structures 210*b* for joining pole structures 205 in one or more upper corners 220 of the frame structure 200; one or more lower corner hub structures 210*c* for joining pole structures 205 in one or more lower corners 225 of the frame structure 200; and a center hub structure 210*d* for joining pole structures 205 in a roof portion 230 of the frame structure 200.

In some embodiments, one or more elements of the frame structure 200 may be omitted. For example, one or more side portions 215 may be omitted from the frame structure 200 to form one or more corresponding openings 235 for doors or other passageways.

Figure 3:
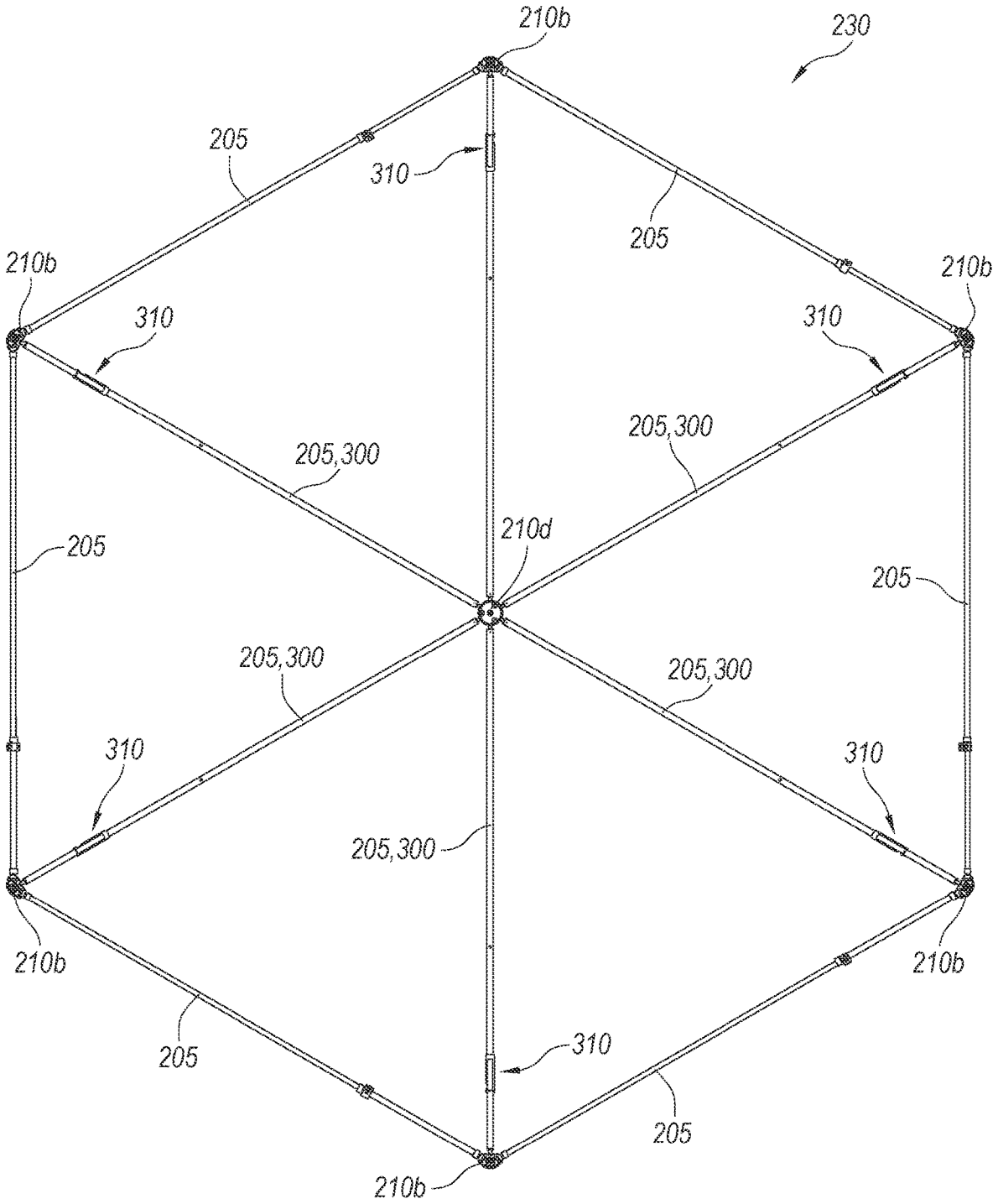
FIG. 3 illustrates a bottom view of a roof portion of a frame structure for a shelter in a deployed configuration, in accordance with embodiments of the present technology.

FIG. 3 illustrates a bottom view of the roof portion 230, configured in accordance with embodiments of the present technology. The roof portion 230 may include one or more telescoping pole structures 300 as one or more of the pole structures 205. For example, in some embodiments, one or more (such as all) of the pole structures 205 connected to the center hub structure 210*d* may be telescoping pole structures 300. The telescoping pole structures 300 are extendable and contractable. When the telescoping pole structures 300 are connected to the center hub structure 210*d* and an upper corner hub structure 210*b*—such that the telescoping pole structures 300 span between the center hub structure 210*d* and the upper corner hub structures 210*b*—a user may increase, decrease, or maintain tension and rigidity in the roof portion 230 (and consequently, the roof 120, see FIG. 1) by operating an extension mechanism 310, as explained in further detail below.

Figure 4A:
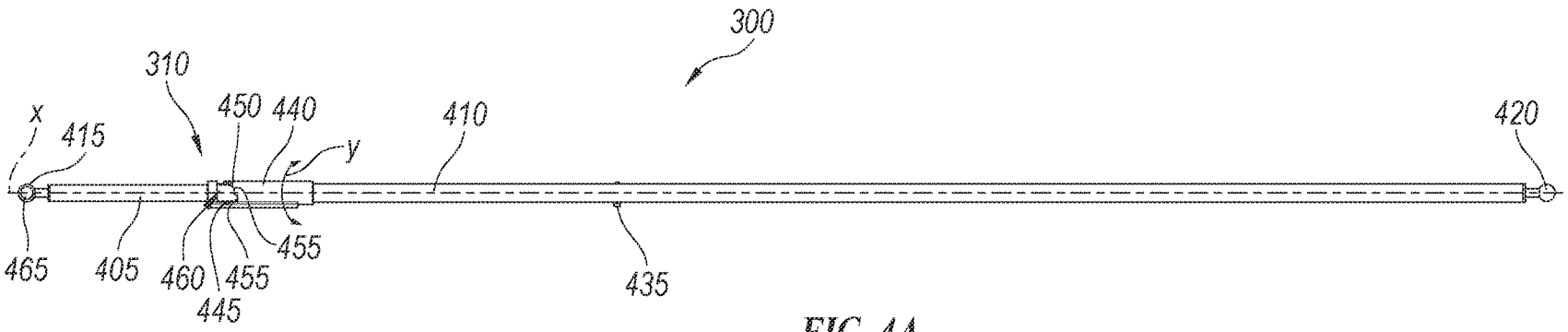
FIGS. 4A-4C illustrate a telescoping pole structure configured in accordance with embodiments of the present technology and suitable for use in the disclosed frame structure or in other frame structures.
Figure 4B:
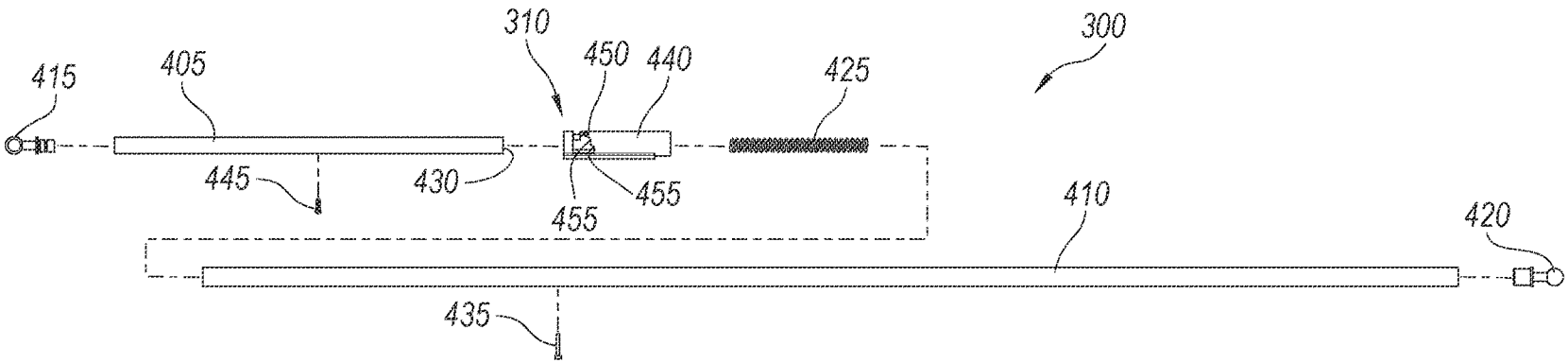
Figure 4C:
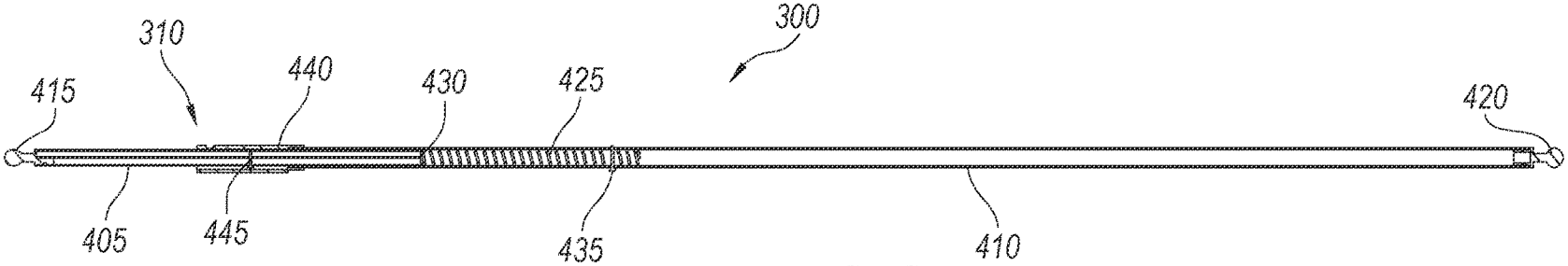

FIGS. 4A-4C illustrate the telescoping pole structure 300, configured in accordance with embodiments of the present technology. FIG. 4A shows a side view of the telescoping pole structure 300, FIG. 4B shows a side view of the telescoping pole structure 300 in an exploded view format, and FIG. 4C shows a side cross-sectional view of the telescoping pole structure 300.

With reference to FIGS. 4A, 4B, and 4C, the telescoping pole structure 300 includes an inner pole portion 405 positioned at least partially within a shell pole portion 410. The inner pole portion 405 slides telescopically within—and relative to—the shell pole portion 410. The inner pole portion 405 may include a first connection element 415. The shell pole portion 410 may include a second connection element 420. The first and second connection elements 415, 420 may connect the telescoping pole structure 300 into the frame structure 200 (see FIG. 2) via hub structures (for example, via the upper corner hub structures 210*b* and the center hub structure 210*d*).

In some embodiments, the telescoping pole structure 300 includes a biasing element 425 for biasing the inner pole portion 405 away from the shell pole portion 410 (in other words, to bias the telescoping pole structure 300 toward an extended configuration that is longer than a retracted configuration of the telescoping pole structure 300). The biasing element 425 can include any suitable device for creating suitable force for biasing the inner pole portion 405 away from the shell pole portion 410. For example, in some embodiments, the biasing element 425 includes a compression spring positioned inside the shell pole portion 410 between an end 430 of the inner pole portion 405 (specifically, the end 430 opposite the end that has the first connection element 415) and a stop element 435. The stop element 435 may be fixed to the shell pole portion 410 at a location that allows the inner pole portion 405 to be moved into the shell pole portion 410 as the biasing element 425 compresses. The biasing element 425 may push against the stop element 435 and against the inner pole portion 405 to tend to cause the inner pole portion 405 to move in a manner that extends the telescoping pole structure 300. In some embodiments, the stop element 435 may include a screw, pin, bolt, or other element passing through the shell pole portion 410 to fix the biasing element 425 in or to the shell pole portion 410.

With additional reference to FIGS. 1-3, the biasing element 425 provides force that adds tension and stability to the frame structure 200 and the roof 120. For example, when a telescoping pole structure 300 is connected to an upper corner hub structure 210*b* and the center hub structure 210*d*, the biasing element 425 of the telescoping pole structure 300 provides force to elevate the center hub structure 210*d* and tension the fabric forming the roof 120. For convenience, according to some embodiments, a user may install the telescoping pole structures 300 when the center hub structure 210*d* is at a relatively low position relative to the remainder of the roof portion 230. In this position, the roof portion 230 may have a generally concave, upwardly opening shape. A user may then push the center hub structure 210*d* upward. As the center hub structure 210*d* moves upward, the telescoping pole structures 300 collapse or retract telescopically (due to geometric constraints of the roof portion 230) until the center hub structure 210*d* is approximately level with the remainder of the roof portion 230.

As the user continues to push the center hub structure 210*d* upward, the roof portion 230 may pop upwardly due to the force from the biasing element 425 tending to bias the telescoping pole structures 300 toward their extended lengths. The center hub structure 210*d* is then positioned higher than the remainder of the roof portion 230, forming a generally convex roof shape pointing upward. At that point, the biasing element 425 may temporarily support the weight of the roof, although the roof portion 230 may flex due to the axial flexure allowed by the telescoping nature of the telescoping pole structures 300.

When the center hub structure 210*d* is in the upward position, the user may operate the extension mechanism 310 to secure the roof portion 230. For example, the telescoping pole structure 300 may include the extension mechanism 310 for increasing or maintaining tension in the roof portion 230 and the roof 120 to support the weight of the roof 120 for an extended time. The extension mechanism 310 also enables reduction of tension for disassembling or stowing the frame structure 200. To increase tension, the extension mechanism 310 extends the telescoping pole structure 300 toward its maximum extended length. To maintain tension, the extension mechanism 310 resists or prevents compression of the telescoping pole structure 300 toward a shortened or contracted length. To reduce tension, the extension mechanism 310 allows the telescoping pole structure 300 to compress toward a shortened or contracted length. Accordingly, the extension mechanism 310 facilitates adjustment and maintenance of a length of the telescoping pole structure 300.

Returning to FIGS. 4A-4C, in some embodiments, the extension mechanism 310 includes a sleeve 440 that is fixed to one of the pole portions 405, 410. In some embodiments, the sleeve 440 is fixed to the shell pole portion 410, such that the sleeve 440 and the shell pole portion 410 may rotate relative to the inner pole portion 405 about a longitudinal axis x of the telescoping pole structure 300, as illustrated by rotation arrow y. The extension mechanism 310 may further include a detent element 445, such as a pin, screw, bolt, or other suitable element, which may be fixed in the other pole portion 405, 410, such as in the inner pole portion 405. In some embodiments, the detent element 445 may be fixed to another part of the telescoping pole structure 300. Contact or engagement between the detent element 445 and the sleeve 440 facilitates adjustment of the telescoping pole structure 300.

In some embodiments, the sleeve 440 includes an engagement surface 450 with one or more surface positions 455 for contacting the detent element 445. The positions 455 on the engagement surface 450 prevent the detent element 445 from passing the engagement surface 450, thereby interfering with the ability of the telescoping pole structure 300 to collapse, retract, or compress. The positions 455 are located at different positions along the longitudinal axis x, such that rotating the sleeve 440 about the longitudinal axis x to change its orientation relative to the longitudinal axis x causes the detent element 445 to engage a selected position 455. Accordingly, the positions 455 provide variable limits on the amount of collapse, retraction, or compression of the telescoping pole structure 300.

In some embodiments, the sleeve 440 includes an opening 460 in a side of the sleeve 440, and the opening 460 may be bounded at least in part by the engagement surface 450. In other embodiments, the engagement surface 450 may be positioned elsewhere, for example, not within an opening in the sleeve 440 (it may be on an end of the sleeve 440 or not surrounded/bounded by other parts of the sleeve 440). To facilitate rotation of the sleeve 440 and the shell pole portion 410 relative to the inner pole portion 405, in some embodiments, the first connection element 415 may include a flat surface 465 or other suitable structure to prevent axial rotation of the inner pole portion 405 relative to the hub to which it is connected (for example, an upper corner hub structure 210*b* or a center hub structure 210*d*).

Figure 5A:
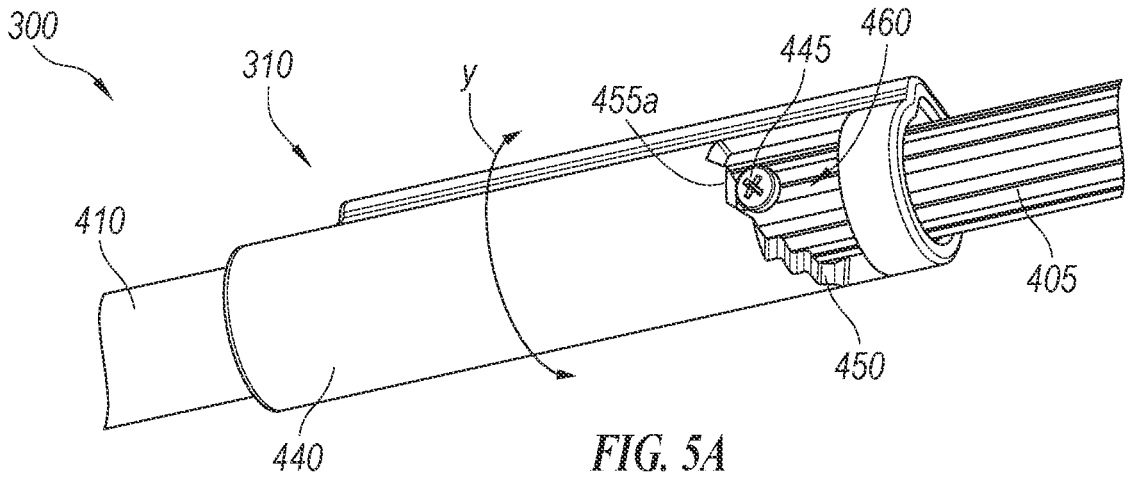
FIGS. 5A-5C illustrate detailed perspective views of an extension mechanism for a telescoping pole structure, configured in accordance with embodiments of the present technology. The views in FIGS. 5A-5C show the extension mechanism in operation for extending and retracting the telescoping pole structure.
Figure 5B:
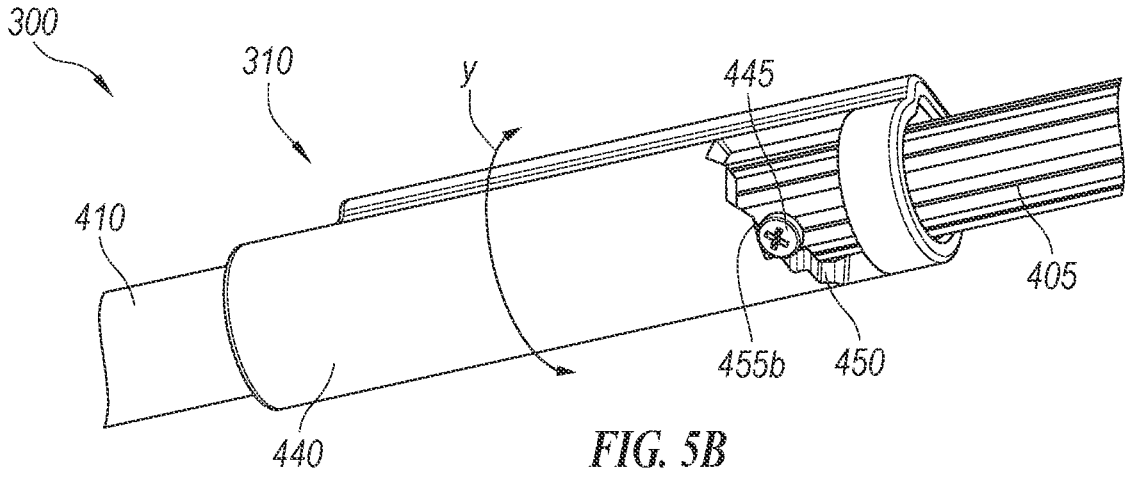
Figure 5C:
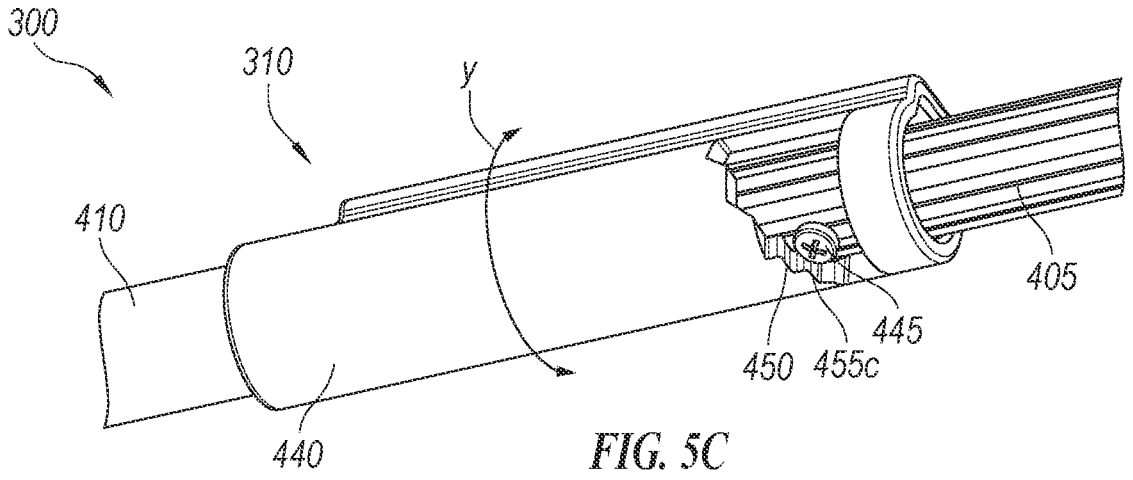

FIGS. 5A-5C illustrate detailed perspective views of the extension mechanism 310 in operation, with the telescoping pole structure 300 extended to different lengths. For example, FIG. 5A shows the detent element 445 engaging a first position 455*a* on the engagement surface 450. FIG. 5B shows the detent element 445 engaging a second position 455*b*. FIG. 5C shows the detent element 445 engaging a third position 455*c*. The positions 455*a*, 455*b*, 455*c* are located at various axial or longitudinal locations along the sleeve 440. Accordingly, when the detent element 445 engages the first position 455*a*, the inner pole portion 405 is positioned relative to the shell pole portion 410 to form a first overall length of the telescoping pole structure 300 that is shorter than when the detent element 445 engages the second position 455*b* or the third position 455*c*. Rotating the sleeve 440 results in extending or contracting the overall length of the telescoping pole structure 300, which enables tensioning or de-tensioning the roof portion 230 and the roof 120.

Described another way, the positions 455*a*, 455*b*, 455*c* may be steps along the engagement surface 450 that hold the detent element 445 (and therefore, the inner pole portion 405) at a selected distance from the second connection element 420 (see FIGS. 4A-4C). The engagement surface 450 may include any suitable number of positions 455. The shape and quantity of positions 455 on the engagement surface 450 may affect the amount of adjustment or the granularity of adjustment of the overall length of the telescoping pole structure 300 (and, accordingly, the amount of adjustment or the granularity of adjustment of tension in the roof portion 230 and the roof 120).

Figure 6A:
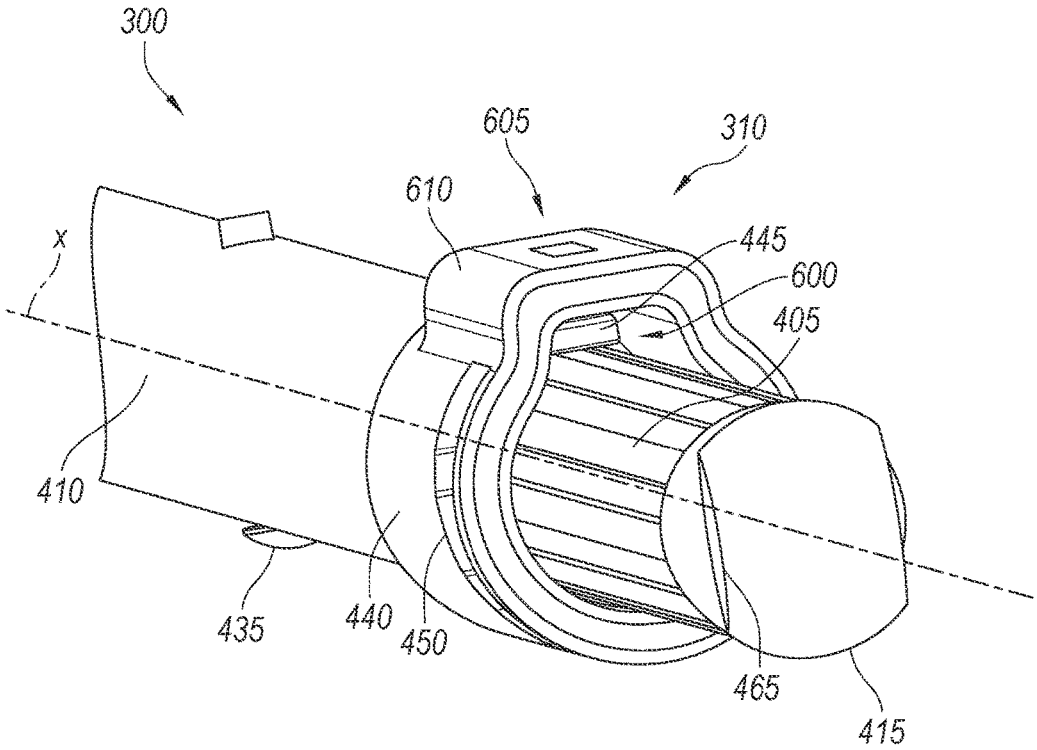
FIGS. 6A and 6B illustrate perspective views of a portion of the telescoping pole structure that includes the extension mechanism.
Figure 6B:
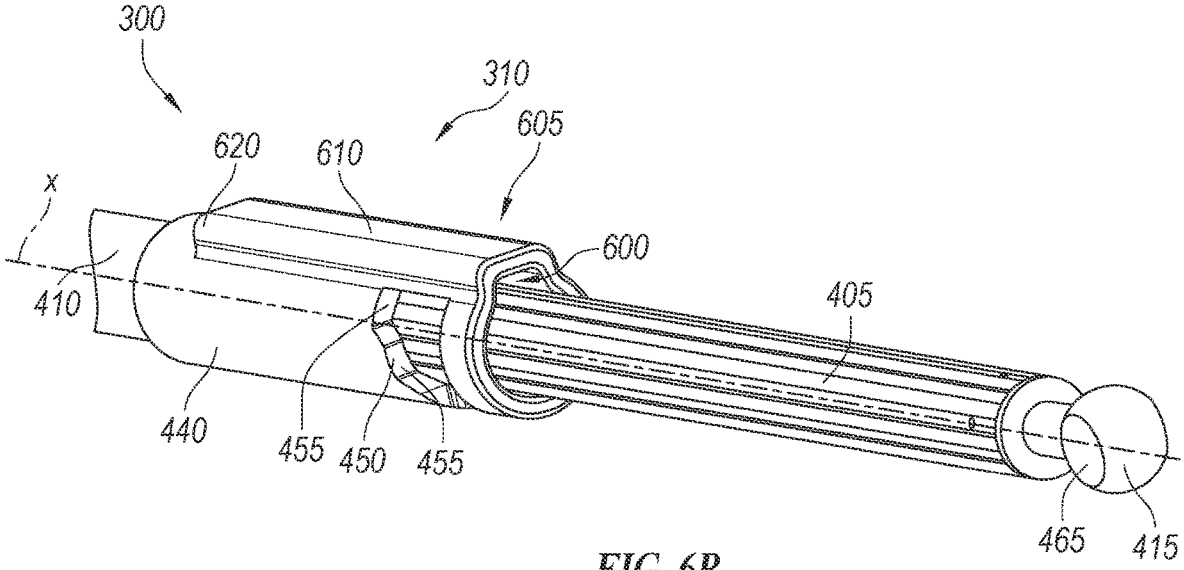

FIGS. 6A and 6B illustrate perspective views of the portion of the telescoping pole structure 300 that includes the extension mechanism 310. With reference to both of FIGS. 6A and 6B, a side 605 of the sleeve 440 may include an elongated slot 600 extending along, but radially offset from, the longitudinal axis x of the telescoping pole structure 300. In some embodiments, the elongated slot 600 may be formed in, or covered with, a radially extending, elongated protrusion 610 on the sleeve 440. The elongated slot 600 is positioned and configured to receive the detent element 445 and enable the detent element 445 to bypass the engagement surface 450. Accordingly, when the sleeve 440 is rotated to a position in which the detent element 445 is positioned in the elongated slot 600, the detent element 445 is movable within the slot 600, the inner pole portion 405 is movable relative to the shell pole portion 410, and the telescoping pole structure 300 may be compressed more than the engagement surface 450 would otherwise allow. For example, the telescoping pole structure 300 may be compressed until the detent element 445 contacts an optional end 620 of the elongated slot 600, until the detent element 445 contacts the shell pole portion 410, until the biasing element 425 (see FIGS. 4B, 4C) prevents further movement, or until another limit is reached in the potential telescopic compression or retraction of the telescoping pole structure 300. The elongated slot 600 allows the telescoping pole structure 300 to compress to a greater degree than the engagement surface 450, which enables more freedom of movement of the telescoping pole structure 300 during deployment, stowage, or other operations.

In operation, with reference to FIGS. 3-6B, a user may rotate the sleeve 440 to an unlocked position in which the detent element 445 is positioned in the elongated slot 600 to allow the telescoping pole structure 300 to extend and contract without interference from the engagement surface 450. The unlocked position may be useful while the roof portion 230 is being assembled or deployed upwardly. When the user wishes to increase stability in the roof portion 230 and the roof 120 by extending the telescoping pole structure 300, the user may manipulate the pole portions 405, 410 and rotate the sleeve 440 to position the detent element 445 at one of the positions 455*a*, 455*b*, 455*c*, or other positions on the engagement surface 450.

Forces from the roof portion 230 and the roof 120 will tend to compress the telescoping pole structure 300, but the detent element 445 pressed against the selected position (for example, position 455*a*, 455*b*, or 455*c*, or another position on the engagement surface 450) will prevent contraction of the telescoping pole structure 300. Accordingly, each telescoping pole structure 300 provides tension, rigidity, and stability to the roof portion 230, the roof 120, and the overall shelter 100. When a user wants to loosen the tension, reduce rigidity, or otherwise disassemble or stow the roof portion 230, the user may rotate the sleeve 440 to position the detent element 445 at a different position (such as position 455*a*, 455*b*, or 455*c*, or another position) or in the elongated slot 600.

Figure 7:
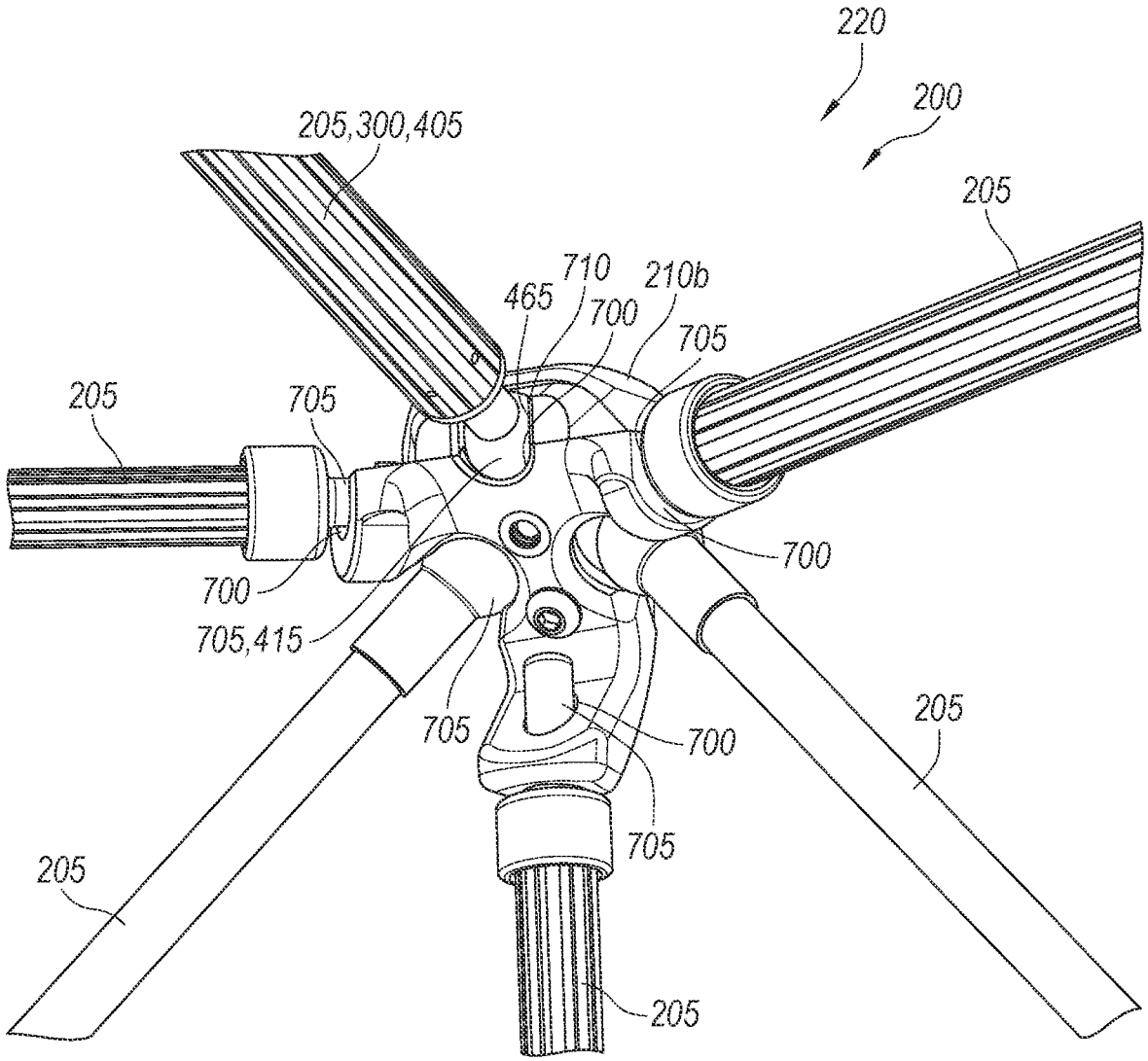
FIG. 7 illustrates a perspective view of an upper corner hub structure for a frame structure, configured in accordance with an embodiment of the present technology.

FIG. 7 illustrates a perspective view of an upper corner hub structure 210*b*, configured in accordance with an embodiment of the present technology. The upper corner hub structure 210*b* may include a plurality of sockets 700 for receiving connection elements 705 of pole structures 205 in the frame structure 200 to join the pole structures 205 together at the upper corners 220. In particular, the upper corner hub structure 210*b* may include a socket 700 that has a flattened region 710 for receiving the first connection element 415 and its flat surface 465 (see FIG. 4A). In some embodiments, the first connection element 415 may be generally round in some portions to facilitate pivoting relative to the upper corner hub structure 210*b*, while the flattened region 710 and the flat surface 465 resist rotation about the longitudinal axis of the telescoping pole structure 300. This resistance to rotation enables the user to rotate the sleeve 440 relative to the inner pole portion 405.

Figure 8:
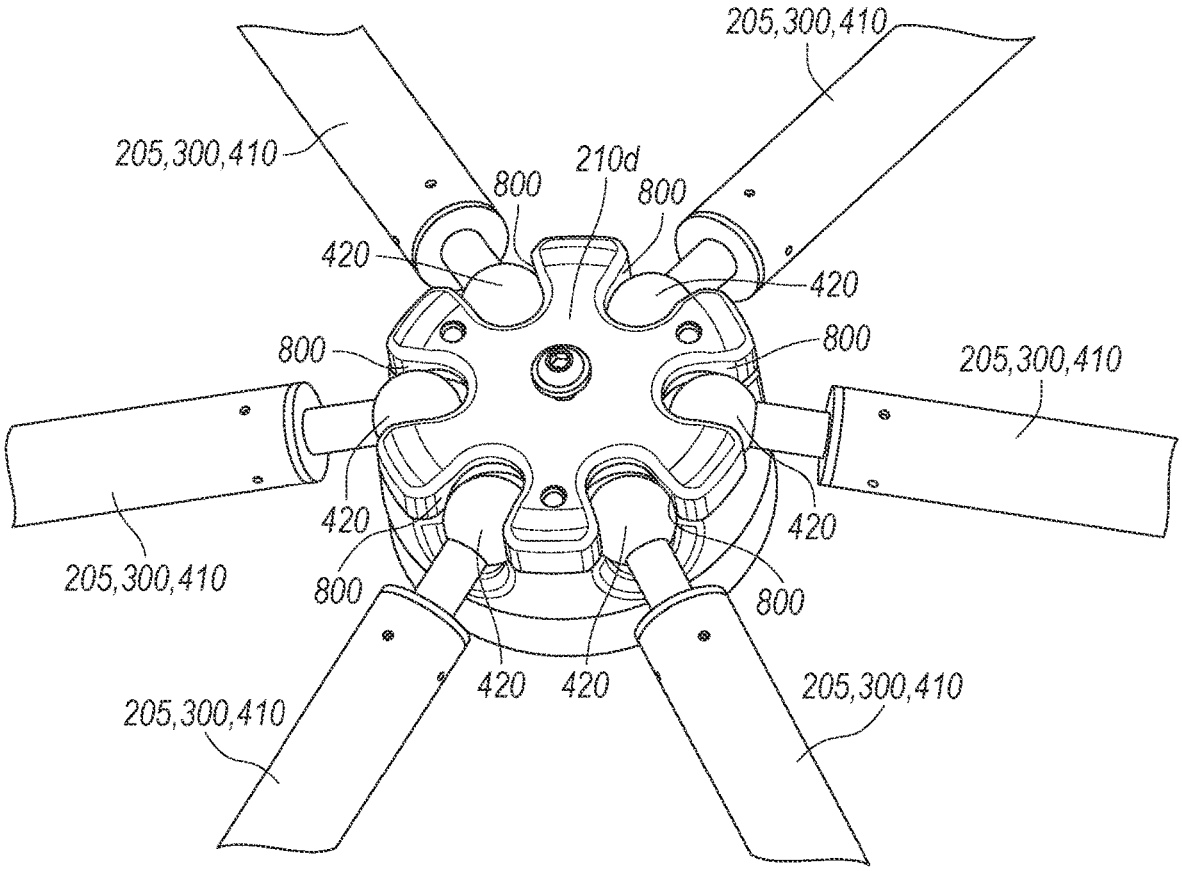
FIG. 8 illustrates a top perspective view of a center hub structure for a frame structure, configured in accordance with embodiments of the present technology.

FIG. 8 illustrates a top perspective view of the center hub structure 210*d*, configured in accordance with embodiments of the present technology. The center hub structure 210*d* may include sockets 800 for receiving the second connection elements 420 of the telescoping pole structures 300 to form a secure and pivotable connection among the telescoping pole structures 300. In some embodiments, the sockets 800 and the second connection elements 420 may form ball-and-socket connections, although other embodiments may include other connection mechanisms between the telescoping pole structures 300 and the center hub structure 210*d*.

In use, frame structures and shelters configured in accordance with embodiments of the present technology may be deployed in any suitable manner, while utilizing the pole structures described herein. For example, frame structures and shelters may be configured to "pop-up" or deploy quickly, after which a user may rigidify the structure using the extension mechanism 310.

In some embodiments, only the roof portion of a frame structure employs telescoping pole structures 300. In other embodiments, the telescoping pole structures 300 may be implemented in any portion of a frame structure, such as one or more sides of a frame structure. Accordingly, any of the pole structures 205 implemented in a frame structure may be a telescoping pole structure 300 described above. In some embodiments, the extension mechanism 310 may be positioned closer to a corner hub structure 210*b* than to a center hub structure 210*d*. In other embodiments, the extension mechanism 310 may be positioned closer to the center hub structure 210*d* than to the corner hub structure 210*b*.

In some embodiments, a shelter may include a single stand-alone wall or a single roof structure configured to be supported by a suitable support structure. For example, individual side portions 215 and roof portions 230 (each of which may include a plurality of pole structures and hubs to form a frame, with one or more panels of material attached thereto) may be implemented independently in various embodiments and oriented in any suitable manner to provide a shelter. A shelter configured in accordance with embodiments of the present technology need not include multiple sides supporting a roof. In some embodiments, a shelter may be an indoor or outdoor partition structure (such as a partition or shade from the sun or wind in an outdoor environment). In some embodiments, a shelter may be in the form of a single wall or partition structure configured to be supported by a corner or an edge of the single wall. In other words, a roof or side structure implementing aspects of the present technology (such as the pole structures) may be deployed independently of other walls or supports associated with a shelter. In some embodiments, therefore, a shelter may include a hub structure, one or more pole structures, and one or more panels of cover material attached to—or supported by—the hub structure and the pole structures.

Various suitable materials may be used to form the various components of the frame structure and the panels. Rigid or generally rigid components such as the hub structures, connection elements, or portions of pole structures may include composite materials such as high-stiffness fiberglass or carbon fiber, high-stiffness plastic materials, or metal materials. In some embodiments, the pole structures may include semi-flexible materials.

Some embodiments of the present technology include kits of parts for assembling a frame structure or shelter. Kits of parts may include some or all of the elements of a frame structure or shelter described herein. For example, a kit of parts may include a plurality of pole structures 205, 300, a suitable quantity of hub structures 210*a*, 210*b*, 210*c*, 210*d*, one or more panels 110, a roof 120, or other components or combinations of components disclosed herein.

Embodiments of the present technology include portable shelters (such as tents, blinds, gazebos, partitions, or other shelter structures) that resist collapse, even when left installed for extended periods of time and in inclement conditions. Telescoping pole structures 300 configured in accordance with embodiments of the present technology enable a user to stiffen the roof or sides of a portable shelter and to apply and maintain tension on the panels used in the roof or sides of a portable shelter. Any suitable number of pole structures may be used in various embodiments.

From the foregoing, it will be appreciated that specific embodiments of the presently disclosed technology have been described herein for purposes of illustration, but that various modifications may be made without deviating from the scope of the technology. For example, although shelters are illustrated herein as having six walls, some embodiments may include more or fewer walls. Although shelters are illustrated as having sheets of material forming walls of the shelters, in some embodiments, one or more sheets of material may be eliminated to form openings in one or more walls or the roof of the shelter. In some embodiments, sheets of material may be omitted entirely (such that some embodiments of the technology include frame structures without walls or a roof).

In some embodiments, a biasing element (e.g., biasing element 425) may be omitted and a user may simply push and hold the center hub structure 210*d* upward before using the extension mechanism 310. Accordingly, telescoping pole structures, roof portions, and shelters configured in accordance with embodiments of the present technology may include other combinations of features disclosed herein. Aspects of embodiments of the present technology may include aspects of elements disclosed in U.S. Patent Application Publication No. 2021/0396037, which is incorporated here in its entirety by reference.

Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. A telescoping pole structure for a shelter, the telescoping pole structure comprising:

a shell pole portion extending along a longitudinal axis;

a sleeve fixed to the shell pole portion;

an inner pole portion extending along the longitudinal axis and positioned at least partially within the shell pole portion and at least partially within the sleeve, wherein the inner pole portion slides telescopically relative to the shell pole portion;

a biasing element positioned to bias the telescoping pole structure toward an extended configuration; and a detent element fixed to the inner pole portion;

wherein:

the sleeve comprises an engagement surface having a plurality of surface positions for contacting the detent element, wherein each surface position is located at a different distance along the longitudinal axis from the shell pole portion than each other surface position;

the sleeve is rotatable relative to the inner pole portion, wherein rotating the sleeve causes the surface positions to move relative to the detent element; and contact between the detent element and each of the surface positions prevents the inner pole portion from moving telescopically into the shell pole portion.

2. The telescoping pole structure of claim 1, wherein the biasing element comprises a spring.

3. The telescoping pole structure of claim 2, wherein the spring is positioned inside the shell pole portion.

4. The telescoping pole structure of claim 1, wherein the engagement surface is positioned in an opening in a side of the sleeve, wherein the opening is bounded at least in part by the engagement surface.

5. The telescoping pole structure of claim 1, wherein the sleeve comprises an elongated slot extending along a side of the sleeve, wherein the slot is configured to receive the detent element and enables the detent element to bypass the engagement surface such that when the sleeve is rotated to a position in which the detent element is positioned in the slot, the inner pole portion is movable relative to the shell pole portion while the detent element is movable within the slot.

6. The telescoping pole structure of claim 5, wherein the sleeve comprises a radially extending protrusion covering the slot.

7. A frame structure for a shelter, the frame structure comprising a center hub structure and a plurality of pole structures, each pole structure of the plurality of pole structures configured to span between the center hub structure and a corner of the frame structure, wherein at least one of the pole structures comprises:

a shell pole portion extending along a longitudinal axis;

a sleeve fixed to the shell pole portion;

an inner pole portion extending along the longitudinal axis and positioned at least partially within the shell pole portion and at least partially within the sleeve, wherein the inner pole portion slides telescopically relative to the shell pole portion;

a biasing element positioned to bias the at least one pole structure toward an extended configuration; and a detent element fixed to the inner pole portion;

wherein:

the sleeve comprises an engagement surface having a plurality of surface positions for contacting the detent element, wherein each surface position is located at a different position along the longitudinal axis than each other surface position;

the sleeve is rotatable relative to the inner pole portion, wherein rotating the sleeve causes the surface positions to move relative to the detent element; and contact between the detent element and each of the surface positions prevents the inner pole portion from moving telescopically into the shell pole portion.

8. The frame structure of claim 7, wherein the biasing element comprises a spring.

9. The frame structure of claim 8, wherein the spring is positioned inside the shell pole portion.

10. The frame structure of claim 7, wherein the engagement surface is positioned in an opening in a side of the sleeve, wherein the opening is bounded at least in part by the engagement surface.

11. The frame structure of claim 7, wherein the sleeve comprises an elongated slot extending along a side of the sleeve, wherein the slot is configured to receive the detent element and enables the detent element to bypass the engagement surface such that when the sleeve is rotated to a position in which the detent element is positioned in the slot, the inner pole portion is movable relative to the shell pole portion while the detent element is movable within the slot.

12. The frame structure of claim 11, wherein the sleeve comprises a radially extending protrusion covering the slot.

13. A shelter comprising a frame structure and one or more cover panels attached to the frame structure, wherein:

the frame structure comprises a plurality of pole structures interconnected with one or more hub structures, wherein the pole structures and the hub structures form one or more side portions of the frame structure and a roof portion of the frame structure; and one or more of the pole structures comprises:

a shell pole portion extending along a longitudinal axis;

a sleeve fixed to the shell pole portion, wherein the sleeve comprises an engagement surface having a plurality of surface positions and an elongated slot extending along a side of the sleeve, wherein each surface position is located at a different position along the longitudinal axis than each other surface position;

an inner pole portion extending along the longitudinal axis and positioned at least partially within the shell pole portion and at least partially within the sleeve, wherein the inner pole portion is positioned to slide telescopically relative to the shell pole portion;

a biasing element positioned to bias the one or more of the pole structures toward an extended configuration; and a detent element fixed to the inner pole portion;

wherein:

the sleeve is rotatable relative to the inner pole portion between a first orientation in which the detent element is positioned in the elongated slot and a second orientation in which the detent element engages one of the surface positions, wherein when the sleeve is in the second orientation, contact between the detent element and the one of the surface positions prevents the inner pole portion from moving telescopically into the shell pole portion.

14. The shelter of claim 13, wherein the one or more of the pole structures comprises a connection element having a flat surface that engages a flattened region of one of the hub structures.

* * * * *